US008414329B2

(12) United States Patent
Morikawa

(10) Patent No.: US 8,414,329 B2
(45) **Date of Patent: *Apr. 9, 2013**

(54) CONNECTOR FOR COAXIAL CABLE

(75) Inventor: Taishi Morikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/201,236

(22) PCT Filed: Feb. 16, 2010

(86) PCT No.: PCT/JP2010/052281

§ 371 (c)(1),
(2), (4) Date: Aug. 12, 2011

(87) PCT Pub. No.: WO2010/093046

PCT Pub. Date: Aug. 19, 2010

(65) Prior Publication Data

US 2011/0294344 A1 Dec. 1, 2011

(30) Foreign Application Priority Data

Feb. 16, 2009 (JP) ..... 2009-032730

(51) Int. Cl.
*H01R 9/05* (2006.01)

(52) U.S. Cl.
USPC ..... 439/585; 439/580; 439/578

(58) Field of Classification Search ..... 439/585, 439/877, 98, 108, 607.45, 607.48, 578, 580, 439/587, 598, 77
See application file for complete search history.

(56) References Cited

U.S. PATENT DOCUMENTS 5,232,380 A * 8/1993 Inoue et al. ..... 439/607.5
7,249,970 B1 * 7/2007 Wei ..... 439/585
8,079,870 B2 * 12/2011 Nakamura et al. ..... 439/585

FOREIGN PATENT DOCUMENTS

JP 59-109080 U 7/1984
JP 04-229577 A 8/1992
JP 06-068938 A 3/1994
JP 11-074036 A 3/1999
JP 11-097120 A 4/1999
JP 11-176527 A 7/1999
JP 2005-243359 A 9/2005

OTHER PUBLICATIONS

International Search Report issued in International application No. PCT/JP2010/052281 on Mar. 16, 2010.

* cited by examiner

*Primary Examiner* — Renee Luebke
*Assistant Examiner* — Harshad Patel
(74) *Attorney, Agent, or Firm* — Sughrue Mion, PLLC

(57) ABSTRACT

A connector for a coaxial cable which enables an end of a shield wire to be held inside a shield terminal as a housing, without generating a backlash, and can be made compact as a whole. Each of crimping barrel parts of a shield terminal is provided with a butting face which is opposed to each of flanges when the crimping barrel parts are folded at its one end, and an inclined face, at the other end at an opposite side to the butting face. The inclined face is brought into sliding contact with the inclined face of the other crimping barrel part when the crimping barrel parts are folded, and the inclined face is inclined to extend in a direction perpendicular to a direction where a pair of the crimping barrel parts are folded.

1 Claim, 9 Drawing Sheets

CONNECTOR FOR COAXIAL CABLE

TECHNICAL FIELD

The present invention relates to a connector for a coaxial cable which is constructed by connecting a shield terminal to a terminal end of a shield wire (a coaxial cable).

BACKGROUND ART

For electrical connection between electric wires or between an electric wire and an electric device to transmit electrical signals, a connector is used. FIG. 9 is a longitudinal sectional view showing a conventional example of such a connector. This connector prevents a terminal fitting 70 which has been inserted into a housing 75 from falling off, by double locking operation using a lance 71 and a retainer 72 (Reference should be made to Patent Document 1, for example).

Specifically, this connector is so constructed that the terminal fitting 70 is formed with a square cylindrical part 73 in a columnar shape, and two locking parts 74 are provided at a rear end edge of the square cylindrical part 73 in parallel with each other in a lateral direction. When the lance 71 and the retainer 72 are arranged in parallel in the lateral direction in the housing 75, the lance 71 is locked to one of the two locking parts 74, and the retainer 72 is locked to the other locking part 74.

Therefore, in this connector, in order to assemble the terminal fitting 70 to the housing 75, the retainer 72 is held in a temporarily locked position, as a first step, and a retaining part 76 is kept retreated out of an insertion passage of the terminal fitting 70. In this state, the terminal fitting 70 is inserted into a cavity 77 from a back side. In a process of this insertion, the terminal fitting 70 and the retainer 72 are held in a non contact state. However, because a front end edge of a support plate 79 of the square cylindrical part 73 is butted against a retaining projection 78 of the lance 71, the lance 71 is retreated out of the insertion passage of the terminal fitting 70, and at the same time, the retaining projection 78 comes into sliding contact with an outer face of the support plate 79. When the lance 71 is bent, a circular face of the support plate 79 is brought into contact with the retaining projection 78, and hence, the lance 71 can be smoothly bent without being caught.

When the terminal fitting 70 has been inserted up to a normal position, the square cylindrical part 73 passes over the retaining projection 78, and the retaining projection 78 is disengaged from the support plate 79 thereby to elastically restore the lance 71. With this elastic restoration of the lance 71, a locking face 78A of the retaining projection 78 is locked to the locking part 74 at the right side of the square cylindrical part 73 from the back side, into a primary locked state. Thereafter, when the retainer 72 which is on standby at the temporarily locked position is pushed upward in a diagonally forward direction, the retainer 72 slides to a normally locked position, and a locking face 76A of the retaining part 76 is locked to the locking part 74 at the left side of the square cylindrical part 73 from the back side, into a secondary locked state. In this manner, the terminal fitting 70 is double locked with the lance 71 and the retainer 72, and reliably held so as not to fall off.

According to this structure, a shape of the terminal fitting 70 can be simplified, because the rear end edge of the square cylindrical part 73 of the terminal fitting 70 serves both as locking means with respect to the lance 71 and locking means with respect to the retainer 72. Moreover, according to this structure, the terminal fitting 70 fitted to a cable 80 will not be inclined to the right or left inside the housing 75, and further, can be locked and held so as not to easily fall off.

PRIOR ART DOCUMENT

<Patent Document>

Patent Document 1: JP-A-2005-243359

SUMMARY OF THE INVENTION

Problems that the Invention ts to Solve

However, in the above described conventional connector, a space (a free area) for allowing the lance 71 to be moved and deformed inside and outside of the insertion passage of the terminal fitting 70, on occasion of mounting the terminal fitting 70, must be secured in the housing 75. Therefore, miniaturization of the housing 75 is restricted because of the free area to be secured. Moreover, even after the terminal fitting 70 has been mounted inside the housing 75, the terminal fitting 70 may be loosened or deformed in the free area. As the results, there has been such disadvantage that unity of the terminal fitting 70 and the housing 75 may be lost. In addition, there has been such disadvantage that molding cost is increased due to a complicated structure of the housing 75.

The invention has been made in view of the above described circumstances, and an object of the invention is to provide a connector for a coaxial cable which enables an end of a shield wire to be stably held by a shield terminal, without generating a backlash, and of which miniaturization and reduction of cost can be realized as a whole.

Means for Solving the Problems

In order to attain the above described object, a connector for a coaxial cable according to the invention has the following feature (1).

(1) A connector for a coaxial cable includes a core wire conduction terminal connected to a core wire which is exposed from a terminal end of a shield wire, an insulating member which holds the core wire conduction terminal in a state contained therein, a shield terminal which is connected to the shield wire by caulking a shield conductor which is positioned around a sheath of the shield wire, and at the same time, holds the insulating member by caulking the insulating member, wherein the insulating member is provided with two flanges protruding from its outer periphery along a circumferential direction, interposing a determined distance in a longitudinal direction, the shield terminal is provided with a pair of crimping barrel parts which are erected so as to clamp the outer periphery of the insulating member, for caulking a region of the insulating member interposed between the flanges, each of the crimping barrel parts is provided with a butting face which is opposed to the flange when the crimping barrel part is folded, at its one end, and an inclined face, at the other end at an opposite side to the butting face, and the inclined face comes into sliding contact with the inclined face of the other crimping barrel part when the crimping barrel parts are folded, and the inclined face is inclined to extend in a direction perpendicular to a direction where the crimping barrel parts are folded.

According to the structure in the above described (1), in case where the shield terminal is mounted to the shield wire, a pair of the crimping barrel parts are erected so as to clamp the outer periphery of the insulating member, and folded along the outer periphery of the insulating member, whereby these crimping barrel parts will not be overlapped on each other, but the inclined faces are brought into sliding contact with each other. As the crimping barrel parts are further folded so as to increase a degree of the sliding contact (to increase an area of the sliding contact) between the inclined faces, the two crimping barrel parts which are in sliding contact between the inclined faces move in a direction apart from each other along the longitudinal direction of the shield wire. For this purpose, the butting faces of the crimping barrel parts respectively opposed to the flanges of the insulating member press the side faces of the flanges opposed to the butting faces so as to spread by pushing. Accordingly, the crimping barrel parts are respectively brought into tight contact with the flanges. As the results, a backlash will not occur in assembling the shield terminal to the shield wire, and electrical connection between the shield terminal and the shield conductor is also stabilized. Moreover, the shield terminal can be obtained at a low cost by stamping and press molding a sheet metal. Therefore, it is possible to provide the connector for a coaxial cable to a market at a low cost and in a large scale.

Advantage of the Invention

According to the invention, it is possible to stably hold an end of the shield wire inside the shield terminal which functions as a connector housing, without generating a backlash, and it is possible to realize miniaturization and reduction of cost of the connector as a whole.

The invention has been briefly described hereinabove. By further reading through the following description of mode for carrying out the invention, referring to the drawings, the details of the invention will be further made clear.

MODE FOR CARRYING OUT THE INVENTION

Figure 1:
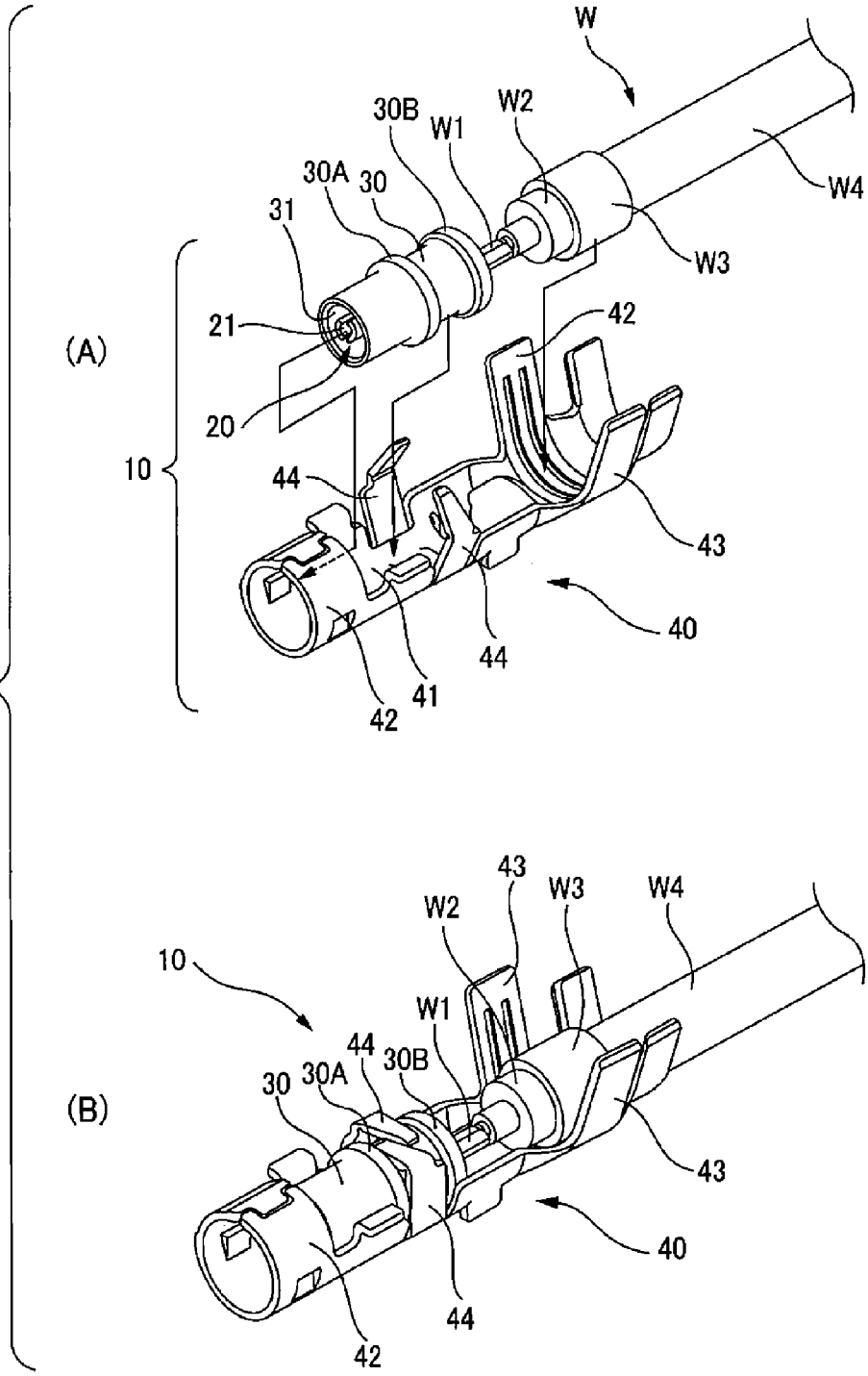
FIG. 1A is an exploded perspective view of a connector for a coaxial cable in an embodiment according to the invention.
FIG. 1B is a perspective view of the connector for a coaxial cable in the embodiment, in a state assembled after a crimping work has been completed.

Now, a preferred embodiment according to the invention will be described in detail, referring to the drawings.

FIGS. 1A and 1B are respectively an exploded perspective view of a connector 10 for a coaxial cable before a crimping structure in the embodiment according to the invention is applied thereto, and a perspective view of an essential part of the connector 10 for a coaxial cable after the crimping structure has been applied thereto.

As shown in FIG. 1, a shield wire W in this embodiment includes a core wire W1 which is an internal conductor, an insulating body (a dielectric body or internal covering) W2 which is extended in a longitudinal direction of the core wire W1 while enclosing an outer peripheral face of the core wire W1, a shield conductor (a braid or the like) W3 which is extended in the longitudinal direction while enclosing an outer peripheral face of the insulating body W2, and a sheath (an external covering) W4 which is extended in the longitudinal direction while enclosing an outer peripheral face of the shield conductor W3.

Moreover, in the connector 10 for a coaxial cable in this embodiment, a connector for the shield wire W is used as the connector. The connector for the shield wire W includes a core wire conduction terminal 20 connected to the core wire W1 which is exposed from a terminal end of the shield wire W, an insulating member 30 for containing the core wire conduction terminal 20 in its containing hole 31, and a shield terminal 40 which is an embodiment of a crimping terminal according to the invention, and connected to the shield conductor W3 for crimping the insulating member 30.

The core wire conduction terminal 20 has an electrical connection part 21 which is electrically connected to a core wire of a mating shield wire to be connected, in order along a direction of inserting into the insulating member 30, and a core wire connecting part (not shown) which is electrically connected to the core wire W1 of the shield wire W, at an opposite side along the direction of inserting into the insulating member 30.

The insulating member 30 is a cylindrical body having a determined wall thickness, and contains the core wire conduction terminal 20 and the core wire connecting part (not shown) in a center part thereof. The insulating member 30 is molded to have such rigidity that it may not collapse when caulked with crimping barrel parts, which will be described below. This insulating member 30 is provided with flanges 30A and 30B having larger diameters than other parts, in a circumferential direction on its outer periphery, at both ends in the longitudinal direction. A distance between these flanges 3A and 3B is set to be such a determined size that a pair of the crimping barrel parts, which will be described below, can be interposed in parallel between them, and a height of the flanges 3A, 3B is designed to be substantially equal to a wall thickness of the crimping barrel parts.

On the other hand, the shield terminal 40 is formed of electrically conductive sheet metal. This shield terminal 40 has a bottom plate part 41 which has a long length along an axial direction of the shield wire W. The bottom plate part 41 is provided with a cylindrical part 42 to be engaged with a distal end of the insulating member 30 to hold it (In turn, this insulating member 30 holds the core wire conduction terminal 20 by enclosing it), at its one end, and shield conductor connecting parts 43 to be electrically connected to the shield conductor W3 of the shield wire W, at the other end. The shield conductor connecting parts 43 of the shield terminal 40, as shown in FIG. 1, are electrically connected to the shield conductor W3, by caulking the shield conductor W3 at one end of the shield wire W.

Further, this shield terminal 40 is provided with a pair of crimping barrel parts 44 to which the crimping structure according to the invention is applied, in an intermediate part between the cylindrical part 42 and the shield conductor connecting part 43. These crimping barrel parts 44 are intended to caulk and crimp the insulating member 30 (or a conductor) into tight contact with respect to the bottom plate part 41, side wall portions 44A and top wall portions 44B, by folding the top wall portions 44B, 44D, which will be described below, so as to enclose the insulating member 30 for securing and holding the insulating member 30, which is an insulating body, with respect to the shield terminal 40.

These crimping barrel parts 44 are erected at positions of the shield terminal 40 corresponding to the insulating member 30 (specifically, a region interposed between the flanges 3A and 3B) so as to clamp the outer periphery of the insulating member 30. These crimping barrel parts 44 are provided, at their respective one ends, with inclined faces 44F, 44G which come into sliding contact with each other, when the top wall portions 44B, 44D are caulked above the insulating member 30. The inclined faces 44F, 44G are inclined in a direction perpendicular to a direction of folding a pair of the crimping barrel parts 44, and hence, the inclined faces 44F, 44G will not be overlapped, even though the top wall portions 44B, 44D are caulked. Further, the crimping barrel parts 44 are provided with butting faces 44H, 44I to be opposed to the flanges 30A, 30B when the crimping barrel parts 44 are folded, at the other ends at opposite sides to the inclined faces 44F, 44G.

Figure 2:
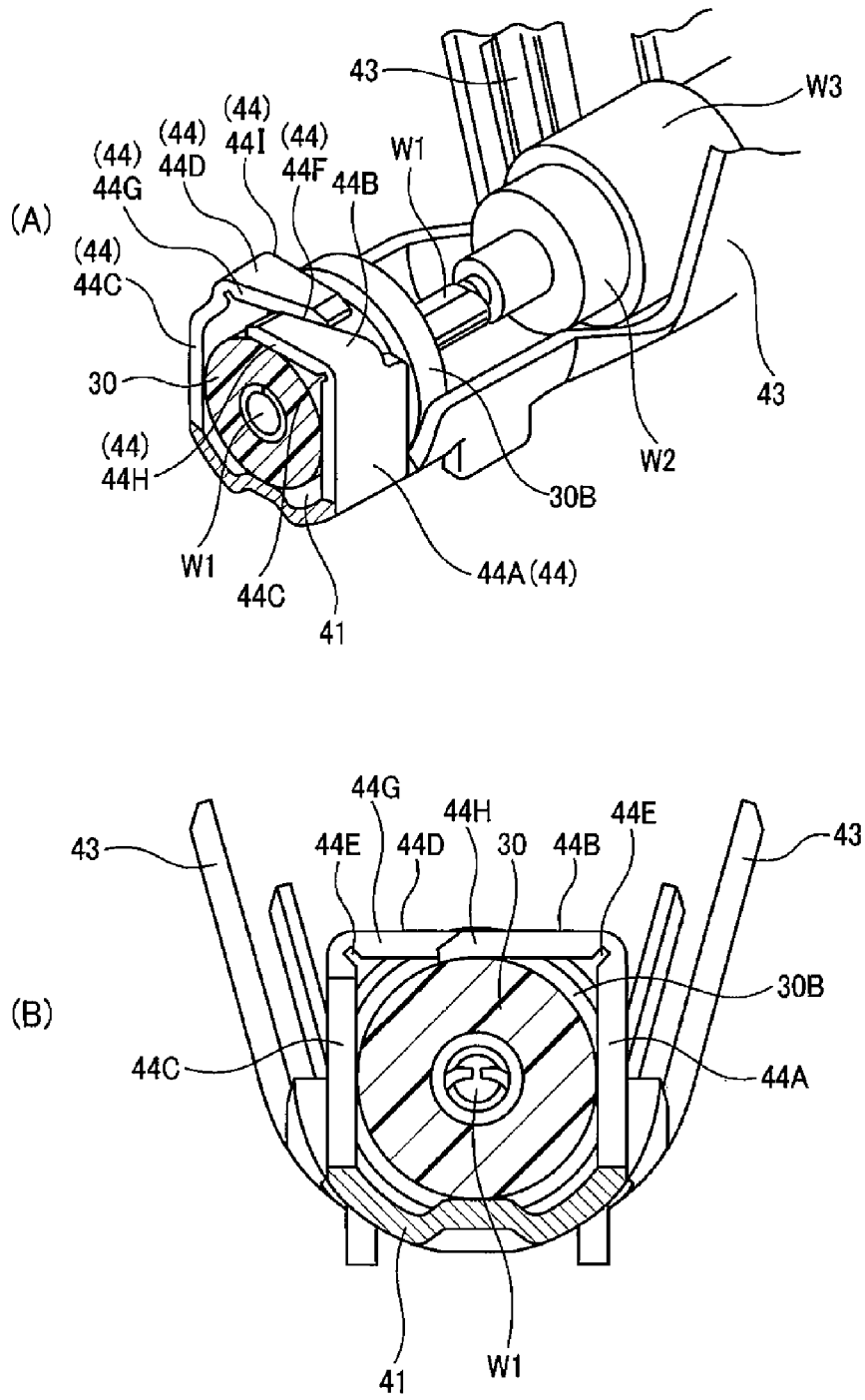
FIG. 2A is a sectional perspective view showing an essential part of the connector for a coaxial cable in the embodiment according to the invention, in a state mounted to a shield wire.
FIG. 2B is a sectional front view of the essential part in FIG. 2A.
Figure 3:
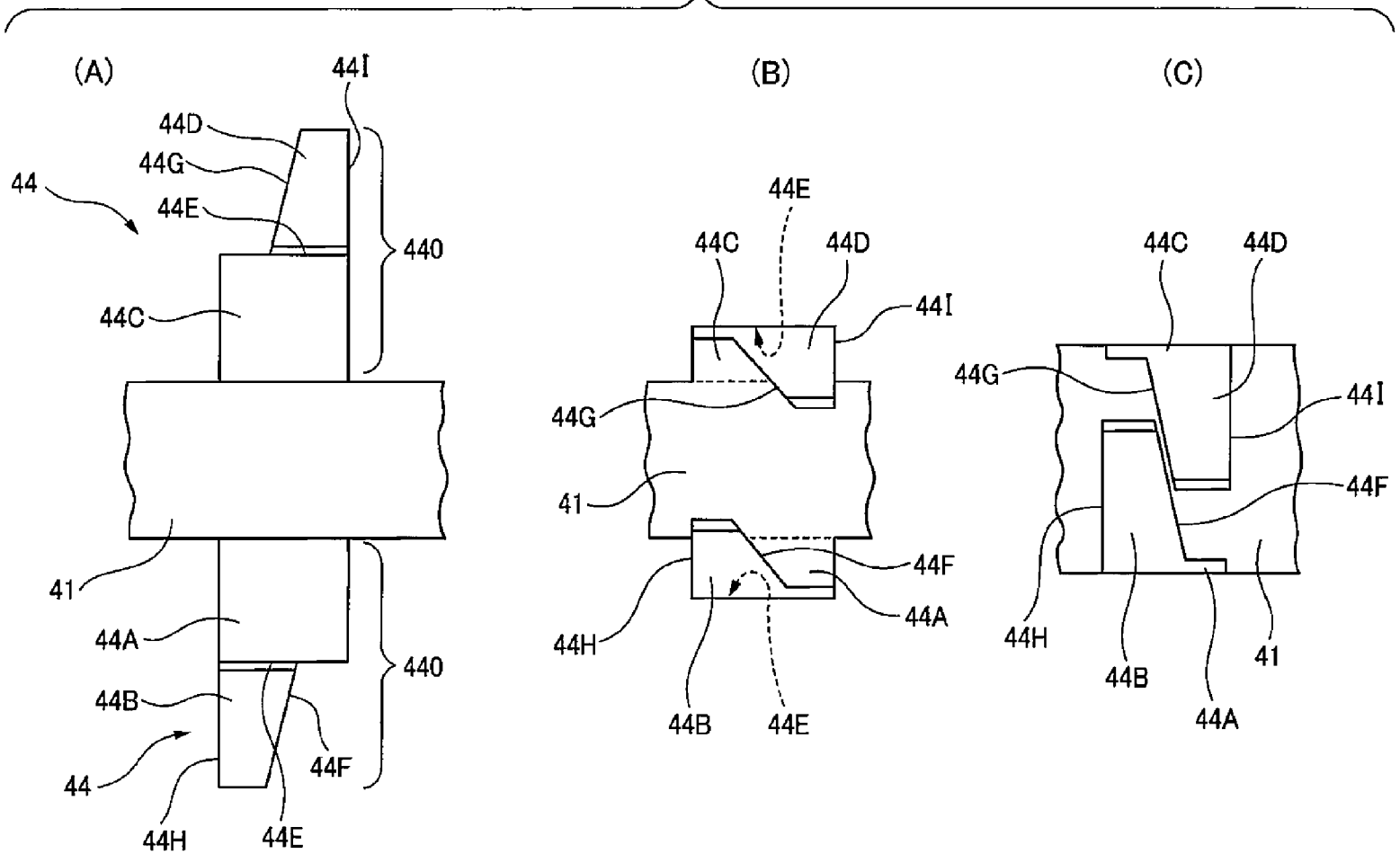
FIGS. 3A to 3C are plan views for respectively explaining steps for working crimping barrel parts by a crimping method of the crimping barrel parts according to the invention.

As shown in a developed view in FIG. 3A, the crimping barrel parts 44 of the shield terminal 40 in this embodiment are formed by applying a determined folding work to a pair of crimping barrel pieces 440 which are formed in complementary shapes having symmetrical relation to each other with respect to a point. Before the insulating member 30 is crimped, the crimping barrel parts 44 have a substantially C-shape in section which is open upward, as shown in FIGS. 1A and 5A. After the insulating member 30 has been crimped, the top wall portions 44B, 44D at a distal end side are folded until they meet the side wall portions 44A, 44C at a right angle, thereby to bring the top wall portions 44B, 44C into a state continued horizontally without being overlapped on each other, as shown in FIGS. 1B, 2A and 2B.

The crimping barrel pieces 440 of the crimping barrel parts 44 immediately before the crimping work will be further described. As shown in FIG. 1A, the crimping barrel pieces 440 respectively includes a pair of side wall portions 44A, 44C which are erected from the bottom plate part 41, and a pair of top wall portions 44B, 44D which are inclined inwardly from upper ends of these side wall portions 44A, 44C. Moreover, a groove in a concave shape (or may be a dent) 44E is provided in a boundary part between the side wall portion 44A and the top wall portion 44B, for enabling the crimping method according to the invention to be reliably performed to exert a desired function.

The side wall portions 44A, 44C are erected from both sides of the bottom plate part 41 inwardly at a determined first angle (an angle $\alpha$ inwardly with respect to a horizontal direction which is parallel to the bottom plate part 41; See FIG. 5A), and then, folded at the right angle with respect to the bottom plate part 41, on occasion of the succeeding crimping work.

The top wall portions 44B, 44D are formed by being folded toward the side wall portions 44A, 44C at the opposite side, in a state inclined at a determined second angle(an angle $\beta$ with respect to the horizontal direction which is parallel to the bottom plate part 41, in this embodiment: See FIG. 5A), around the grooves (may be dents) 4E which are formed in regions separated from respective boundary parts between the bottom plate part 41 and the side wall portions 44A, 44C toward distal ends of the side wall portions 44A, 44C, by a certain length. This folding work for forming the top wall portions 44B, 44D is usually conducted in advance before applying the crimping work, but on occasion of the succeeding crimping work, a further folding work is additionally applied so that the top wall portions 44B, 44D may be brought into horizontal state in parallel with the bottom plate part 41.

Now, a method of crimping the crimping barrel parts according to the invention will be described in detail, referring to the drawings.

The crimping method in this embodiment is applied, when the shield terminal 40 is mounted to the shield wire W to which the core wire conduction terminal 20 and the insulating member 30 have been already mounted, as described above in FIG. 1A, and more particularly, applied when the insulating member 30 is crimped by the crimping barrel parts 44. The crimping method will be further described referring to the drawings.

Figure 4:
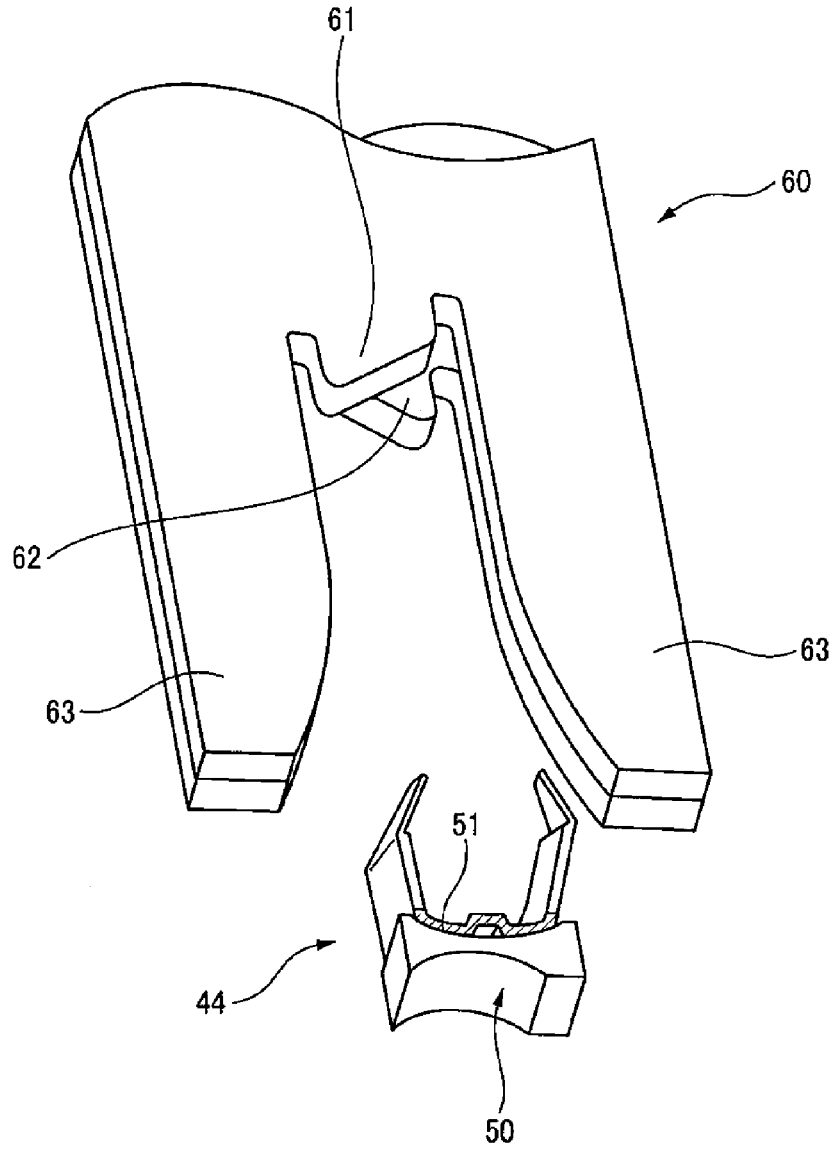
FIG. 4 is an explanatory view showing a crimping device which is used in the crimping method of the crimping barrel parts according to the invention.
Figure 5:
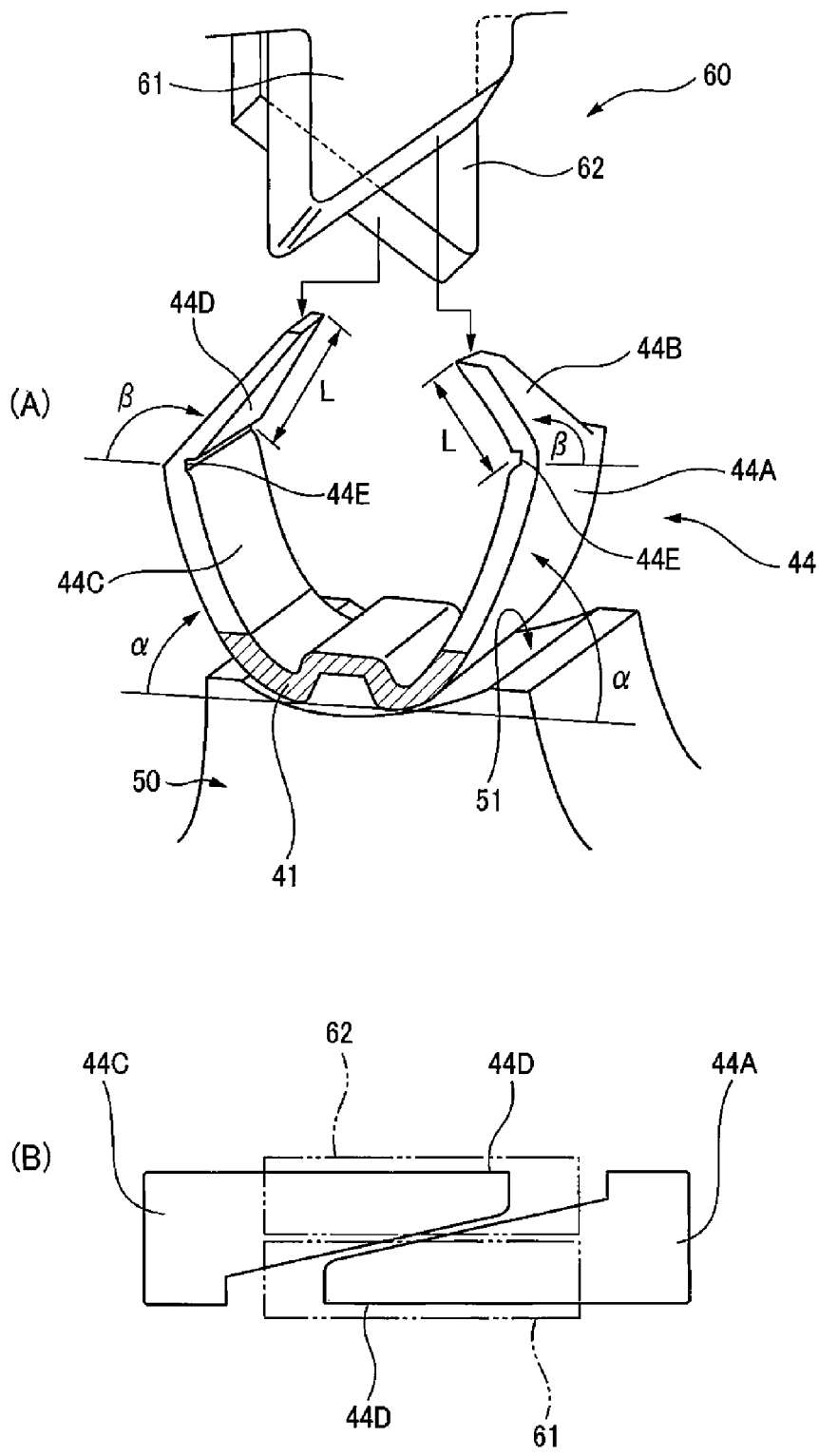
FIG. 5A is a perspective view showing relative relation between pressing projections of the crimping device and top wall portions of the crimping barrel parts according to the invention.
FIG. 5B is a plan view schematically showing the relative relation between the pressing projections of the crimping device and the top wall portions of the crimping barrel parts, as seen from above.

As a first step, an anvil 50 and a crimper 60 composing an essential part of a crimping device (a crimping tool) which is used in this crimping method will be described referring to FIGS. 4 and 5.

The anvil 50 has a concave part 51 for placing the bottom plate part 41 of the crimping barrel parts 44, on its upper face. On the other hand, the crimper 60 has two leg portions 63, and pressing projections 61 and 62 having same inclined faces for pressing the top wall portions 44B, 44D, which are formed in a complementary shape so as not to interfere with each other, are provided in parallel in a staggered manner (that is, in opposite directions by 180 degree) on a ceiling part between the leg portions 63 (See FIG. 5B).

Specifically, the pressing projection 61 presses and pushes down the top wall portion 44B inwardly (toward the bottom plate part 41) thereby to caulk the top wall portion 44B to crimp it to a part (a half at this side in FIG. 1B) of the insulating member 30. For this purpose, in FIGS. 5A and 5B, the pressing projection 61 is inclined downward to the left in such a manner that its left side corresponding to a distal end side of the top wall portion 44B protrudes larger downward.

On the other hand, the pressing projection 62 presses and pushes down the top wall portion 44D inwardly (toward the bottom plate part 41) thereby to caulk the top wall portion 44D to crimp it to a part (a half at a deep side in FIG. 1B) of the insulating member 30. For this purpose, in FIGS. 5A and 5B, the pressing projection 62 is inclined downward to the right in such a manner that its right side corresponding to a distal end side of the top wall portion 44D protrudes larger downward.

Then, details of the crimping method according to the invention will be described referring to FIGS. 7 and 8.

The crimping method according to the invention includes a first step constituting a preliminary step for forming the top wall portions 44B, 44D on the crimping barrel parts 44 of the shield terminal 40, a second step for folding the side wall portions 44A, 44C at the right angle with respect to the bottom plate part 41, and a third step for pressing and pushing down the top wall portions 44B, 44D until they come into contact with the insulating member 30.

After the third step, a spring back occurs in the top wall portions 44B, 44D to rotate them around the joint parts between the side wall portions 44A, 44C and the top wall portions 44B, 44D, or the boundary parts between the bottom plate part 41 and the side wall portions 44A, 44C. As the results, the top wall portions 44B, 44D are reversely restored to some extent. In this manner, the top wall portions 44B, 44D are maintained in a flat shape at a desired height from the bottom plate part 41, and the calking and crimping work is completed.

Then, working steps in the respective steps will be described in detail.

(i) In the first step, as shown in FIG. 5A, the side wall portions 44A, 44C are folded so as to be erected at the first angle α from both sides in a lateral direction of the bottom plate part 41 of the shield terminal 40. Then, the side wall portions 44A, 44C are folded toward the side wall portions 44A, 44C at the opposite side, around the grooves (may be dents) 44E which have been previously formed at positions backward from the distal ends of the side wall portions 44A, 44C toward their base ends by a certain length L (a slightly longer than a half of the length of the bottom plate part 41 in the lateral direction), at the determined second angle (the angle β with respect to the horizontal direction which is parallel to the bottom plate part 41). In this manner, the top wall portions 44B, 44D are formed, in advance, at the distal end sides of the side wall portions 44A, 44C.

Specifically, the shield terminal 40 in a state as shown in FIG. 1A is formed. Thereafter, the shield wire W to which the core wire conduction terminal 20 and the insulating member 30 have been already mounted is set at a determined position of the shield terminal 40. Particularly, the distal end portion of the insulating member 30 is kept inserted into the cylindrical part 42. The shield conductor connecting parts 43 are erected at both sides of the shield conductor W3 of the shield wire so as to clamp the shield conductor W3 between them. Then, the shield conductor connecting parts 43 are calked over the shield conductor W3, before or after the caulking operation of the crimping barrel parts 44, as described below.

Figure 6:
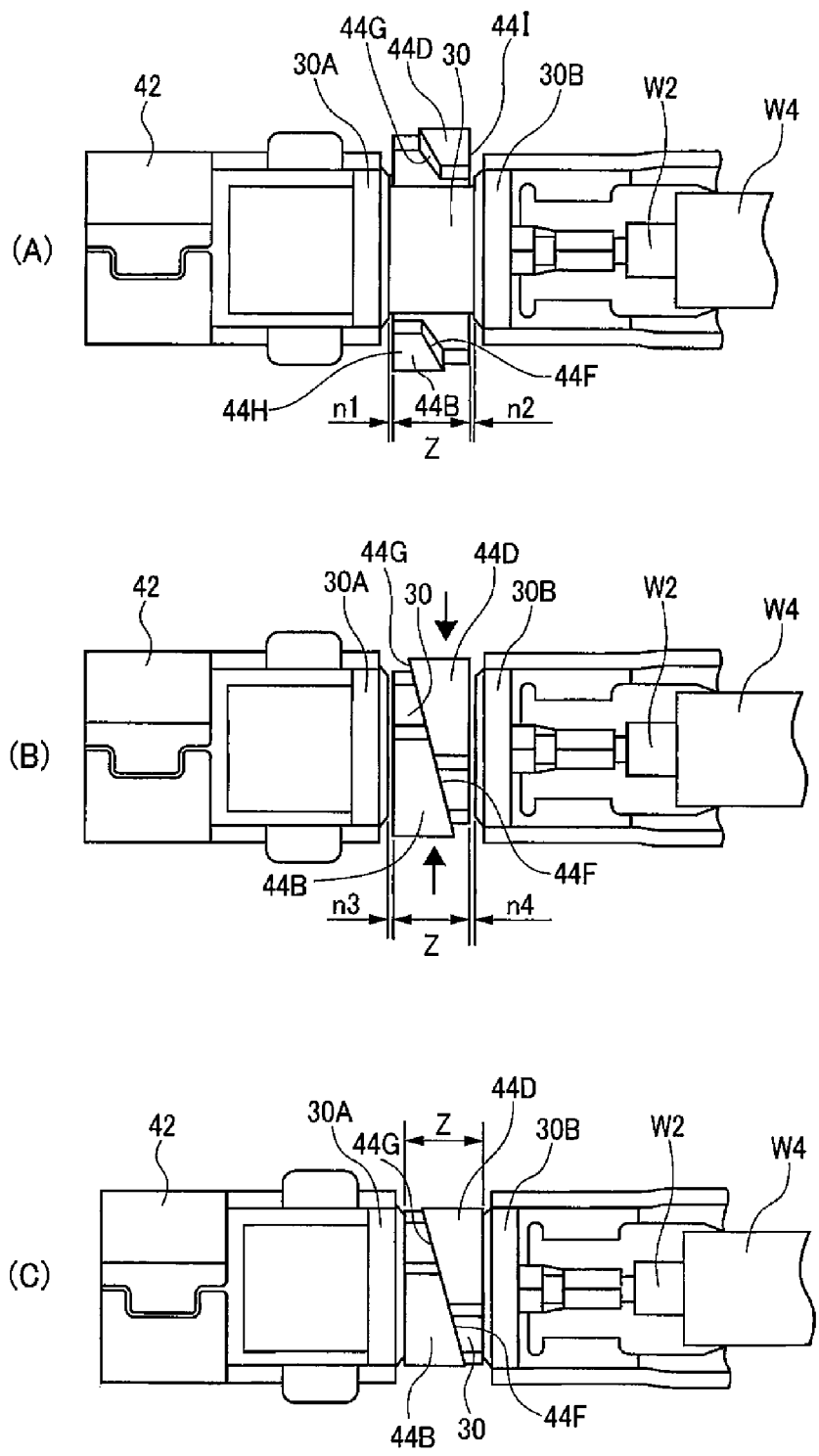
FIGS. 6A to 6C are explanatory views respectively showing steps for preventing occurrence of a backlash between the crimping barrel parts and flanges of an insulating member according to the invention.

In a state where the shield wire W has been set with respect to the shield terminal 40, gaps n1, n2 are kept between the butting faces 44H, 44I of the crimping barrel parts 44 and the opposed faces of the flanges 30A, 30B to be opposed thereto at both ends of the insulating member 30, as shown in FIG. 6A. On this occasion, the crimping barrel parts 44 do not yet cover the upper part of the outer periphery of the insulating member 30.

(ii) In the second step, as shown in FIGS. 7A, 7B, the crimping barrel parts 44 of the shield terminal 40 are placed in the concave part 51 on the upper face of the anvil 50, and this anvil 50 carrying the crimping barrel parts 44 is inserted between the two leg portions 63 of the crimper 60. Thereafter, the anvil 50 is gradually elevated toward the pressing projections 61 (Alternatively, the crimper 60 may be lowered so as to approach the anvil 50). As the results, both the side wall portions 44A, 44C are folded by the right and left leg portions 63, up to positions immediately before the distal ends of both the top wall portions 44B, 44D are respectively brought into contact with the pressing projections 61, 62. Then, both the side wall portions 44A, 44C are folded, until they meet the bottom plate part 41 at a substantially right angle where they are folded by about 90 degree from the horizontal direction which is parallel to the bottom plate part 41.

Figure 7:
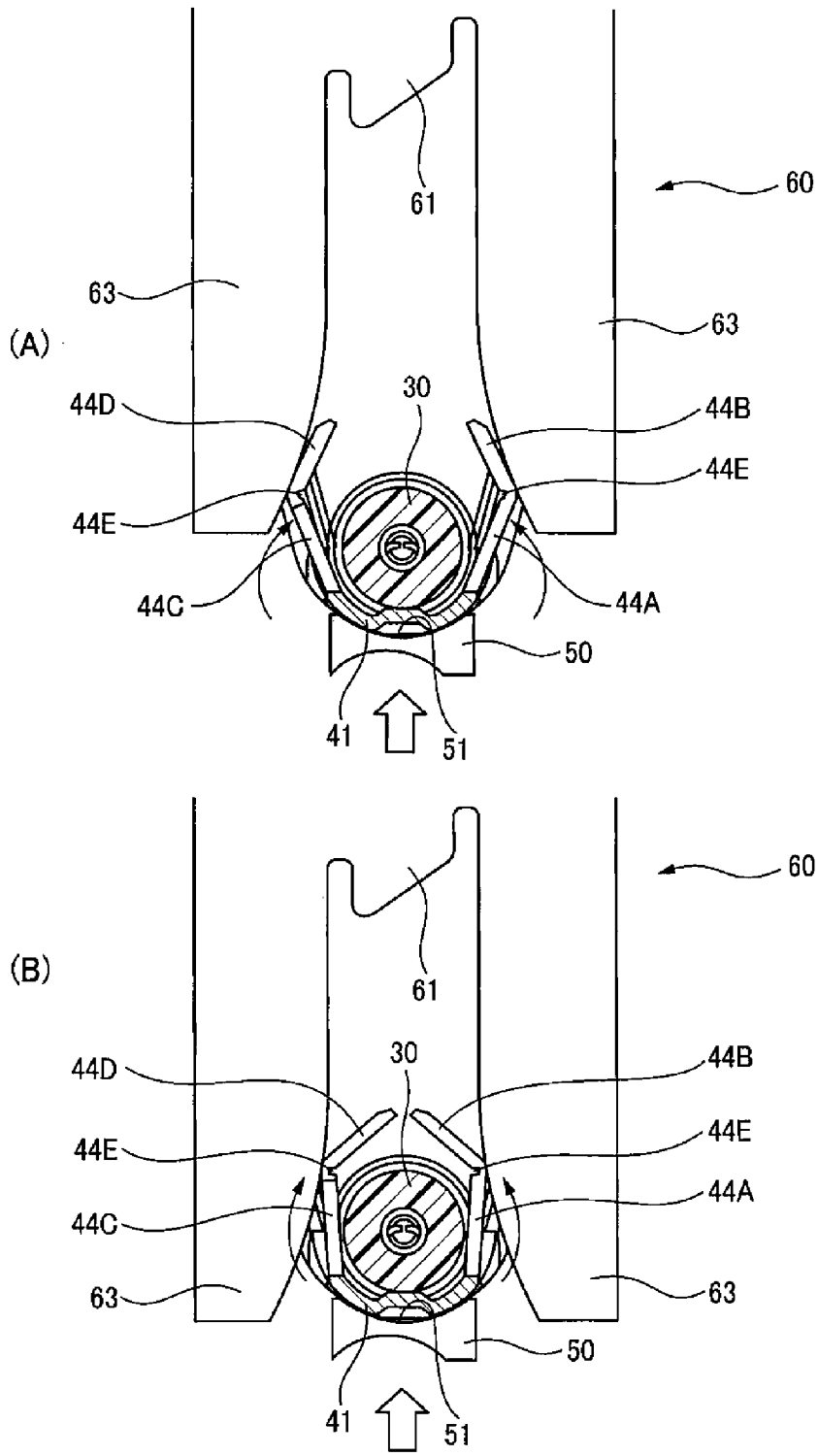
FIGS. 7A and 7B are explanatory views respectively showing preliminary stages of the crimping method of the crimping barrel parts according to the invention.

(iii) In the third step, as shown in FIGS. 8A, 8B, the top wall portions 44B, 44D are pressed and folded by the pressing projections 61, 62 (for convenience of explanation, the pressing projection 62 which is positioned at the rear side is omitted in FIG. 7) which are provided on the ceiling face of the crimper 60 so as to be opposed to both the top wall portions 44B, 44C of the crimping barrel parts 44 in a state placed on the anvil 50, until the top wall portions 44B, 44D are brought into contact with the insulating member 30 to be crimped. This folded state is shown in FIG. 6B. The crimping barrel parts 44 are folded so as not to be overlapped on each other above the insulating member 30, and in such a manner that the inclined faces 44F, 44G come into sliding contact with each other. As shown in FIG. 6B, in a starting period of the folding work, as an angle of folding is made larger, that is, as an area of a sliding contact face between the inclined faces 44F, 44G is increased, the crimping barrel parts 44 move so as to be separated from each other along the longitudinal direction of the shield wire W, and a distance Z between the butting faces 44H, 44I of the crimping barrel parts 44 is enlarged. Accordingly, gaps n3, n4 between the butting faces 44H, 44I and the opposed faces of the flanges 30A, 30B of the insulating member 30 opposed thereto gradually become smaller as compared with the gaps n1, n2. While the gaps n3, n4 further become smaller in this manner, both the top wall portions 44B, 44D are folded by the pressing projections 61, 62 to reach the substantially right angle where they come into contact with the insulating member 30.

Figure 8:
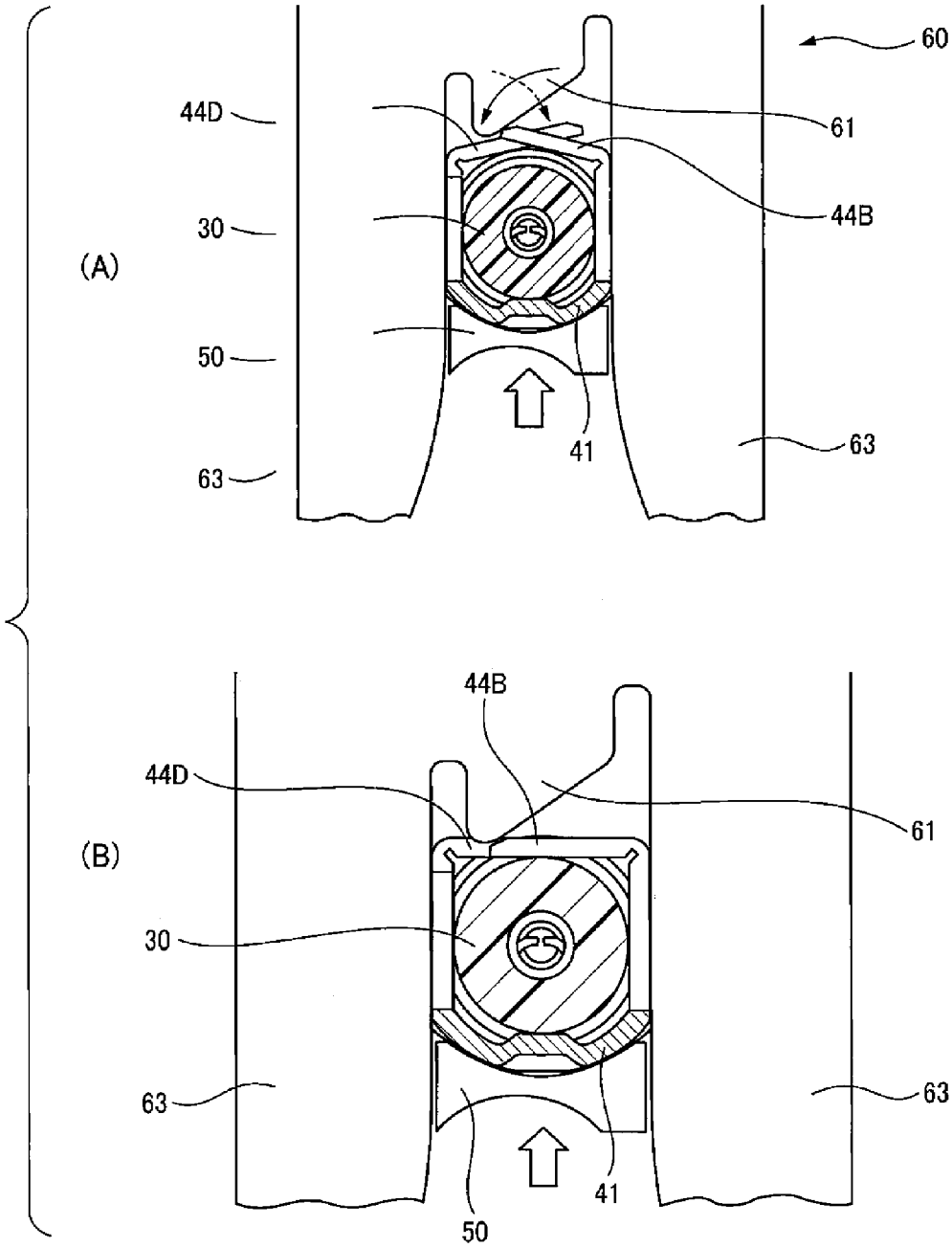
FIGS. 8A and 8B are explanatory views respectively showing intermediate stages of the crimping method of the crimping barrel parts according to the invention.
Figure 9:
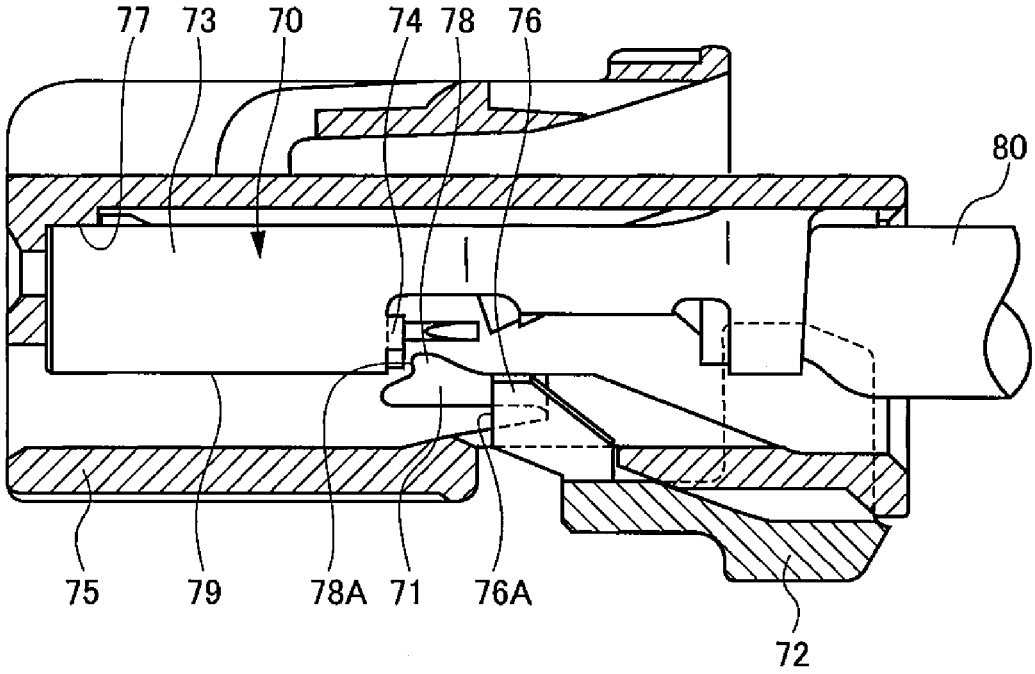
FIG. 9 is a longitudinal sectional view of a conventional connector.

By the way, as shown in FIGS. 7 and 8, in the process where the top wall portions 44B, 44D are folded, their inclined faces 44F, 44G deeply come into sliding contact with each other from the state as shown in FIG. 6B. When the area of the sliding contact face between their inclined faces 44F, 44G has reached a determined value, the distance Z between their butting faces 44H, 44I becomes equal to the distance between the opposed faces of the two flanges 30A, 30B of the insulating member 30. Specifically, the sliding contact will not proceed further, and as shown in FIG. 6C, the gaps (backlash) will not occur between the butting faces 44H, 44I and the opposed side faces of the flanges 30A, 30B. At this timing, a series of the crimping works by the pressing projections 61, 62 are completed. Therefore, by preventing occurrence of the backlash in this manner, occurrence of an assembling error (backlash) between the shield wire W and the shield terminal 40 to be connected thereto can be avoided.

As described above, in this embodiment, the shield terminal 40 is provided, in the region corresponding to the insulating member 30, with a pair of the crimping barrel parts 44 which are erected so as to clamp the outer periphery of the insulating member 30. Moreover, the crimping barrel parts 44 are provided with the inclined faces 44F, 44G which come into sliding contact with each other, when the crimping barrel parts 44 are folded so as not to be overlapped on each other above the insulating member 30, and the butting faces 44H, 44I which are butted against the side faces of the flanges 30A, 30B opposed to each other, by increasing the area of the sliding contact between the inclined faces 44F, 44G.

Therefore, it is possible to hold the shield wire W in the shield terminal 40 which encloses this shield wire W, without generating a backlash, and at the same time, an entirety of the connector for a coaxial cable can be made compact and can be produced at a low cost.

The invention is not limited to the above described embodiment, but modifications, improvements and so on can be appropriately made. Additionally, materials, shapes, sizes, numbers, positions to be arranged and so on of the constituent elements in the above described embodiment are not limited, but optional, provided that the invention can be attained.

Although the invention has been fully described referring to the specified embodiment, it is apparent to those skilled in the art that various modifications and amendments can be added without deviating from the spirit of the invention.

This application is based on Japanese Patent Application filed on Feb. 16, 2009 (Japanese Patent Application No. 2009-032730), of which contents are hereby incorporated by reference.

Description of the Reference Numerals and Signs

10 Connector for coaxial cable
20 Core wire conduction terminal
21 Electrical connection part
30 Insulating member
30A, 30B Flange
40 Shield terminal
41 Bottom plate part
42 Cylindrical part
43 Shield conductor connecting part
44 Crimping barrel part
440 Crimping barrel piece
44A, 44C Side wall portion
44B, 44D Top wall portion
44E Groove (or dent)
44F, 44G Inclined face
44H, 44I Butting face
50 Anvil
51 Concave part
60 Crimper
61, 62 Pressing projection
α First angle
β Second angle
W1 Core wire
W2 Insulating body
W3 Shield conductor
W4 Sheath

The invention claimed is:

1. A connector for a coaxial cable, comprising:

a core wire conduction terminal, connected to a core wire exposed from a terminal end of a shield wire, an insulating member, which holds the core wire conduction terminal in a state contained therein, a shield terminal, which is connected to the shield wire by caulking a shield conductor that is positioned around a sheath of the shield wire, and at the same time, holds the insulating member by caulking the insulating member, wherein the insulating member is provided with two flanges protruding from its outer periphery along a circumferential direction, interposing a determined distance in a longitudinal direction, the shield terminal is provided with a pair of crimping barrel parts which are erected so as to clamp the outer periphery of the insulating member, for caulking a region of the insulating member interposed between the flanges, each of the crimping barrel parts is provided with a butting face which is opposed to a corresponding one of the flanges when the crimping barrel part is folded, at its one end, and an inclined face, at the other end at an opposite side to the butting face, the inclined face comes into sliding contact with the inclined face of the other crimping barrel part when the crimping barrel parts are folded, and the inclined face is inclined to extend in a direction perpendicular to a direction where the crimping barrel parts are folded.

* * * * *